United States Patent [19]

Canon

[11] 3,972,286

[45] *Aug. 3, 1976

[54] BULLET

[76] Inventor: Jack Y. Canon, 2194 Delmas, Opelousas, La. 70570

[ * ] Notice: The portion of the term of this patent subsequent to Oct. 14, 1992, has been disclaimed.

[22] Filed: Nov. 5, 1974

[21] Appl. No.: 521,084

Related U.S. Application Data

[60] Division of Ser. No. 405,781, Oct. 12, 1973, Pat. No. 3,911,820, which is a continuation-in-part of Ser. No. 237,271, March 23, 1972, abandoned.

[52] U.S. Cl. ..... 102/38; 102/91; 102/92.1

[51] Int. Cl.[2] ..... F42B 5/02

[58] Field of Search ..... 102/91, 92, 92.2, 92.3, 102/92.4, 92.7, 38, 42, 42 C, 41, 53, 67

[56] References Cited

UNITED STATES PATENTS

| | | | |
|---|---|---|---|
| 2,105,528 | 1/1938 | Foisy | 102/53 |
| 2,464,604 | 3/1949 | Palagonia | 102/67 |
| 2,820,412 | 1/1958 | Beedwkes | 102/91 X |
| 3,429,263 | 2/1969 | Snyder et al. | 102/92.7 |
| 3,508,493 | 4/1970 | Olenick, Jr. | 102/67 |
| 3,616,758 | 11/1971 | Komarov | 102/92 |
| 3,756,158 | 9/1973 | Anderson | 102/91 |

FOREIGN PATENTS OR APPLICATIONS

| | | | |
|---|---|---|---|
| 23,798 | 3/1911 | United Kingdom | 102/67 |

*Primary Examiner*—Samuel W. Engle
*Assistant Examiner*—Harold Tudor
*Attorney, Agent, or Firm*—Larson, Taylor & Hinds

[57] ABSTRACT

A ricochet-resistant bullet has a tip of impact frangible material, and a hollow casing filled with heavy particles, which may be wet or suspended in a liquid, and dispersible upon frangible impact of the bullet with a target.

15 Claims, 3 Drawing Figures

BULLET

This application is a division of my copending application Ser. No. 405,781, filed Oct. 12, 1973, now U.S. Pat. No. 3,911,820, of Oct. 14, 1975, which in turn was a continuation-in-part of my copending application, Ser. No. 237,271, filed Mar. 23, 1972, now abandoned, and relates to a ricochet-resistant bullet. More particularly, the invention relates to a bullet having an impact frangible casing containing finely-divided heavy particles dispersible in the target upon impact, and a tip closing the casing and formed of an impact frangible material. The casing in one preferred form may also contain a liquid.

The bullet of the present invention is designed to remain as an integral missile following firing, retaining its structure until broken upon impact with the target surface. The hollow bullet casing is filled with individual heavy particles, usually metal, which may be suspended in and thereby loosely aggregated together by, the liquid, preferably a viscous liquid to semi-solid gel or paste; whereby, upon impact of the bullet with the target, the bullet casing breaks, releasing the heavy particles which enter the target and are scattered therein in a controlled cone. These particles scatter only upon impact with the target, but remain as an integral body until the confining casing is broken by contact with the target surface.

The bullet is preferably frangibly sealed to a blunted or rounded tip to prevent ricochet, and the tip is generally formed of impact destructible plastic. There may be substituted as other tip substances fiber reenforced plastic, or even metal, in order to accommodate variable bullet velocities projected from different size guns with varying muzzle velocities. The tip is fastened to the casing in a manner to remain frangibly secured thereto, confining the contents within the casing until impact, even at high velocities. For this purpose the bullets hereof will be made variable in size for rifles and for 22 to 45 calibre hand guns or rifles.

In accordance with the invention, a spin stabilized bullet for rifled bore small arms is provided, comprising a hollow open-ended missile casing formed for releasable coupling with a cartridge carrying a propellant charge, the casing being of substantially cylindrical form over at least the major portion of its length such that the major cylindrical portion defines substantially the full calibre of the bullet, the casing having a closed base end and enclosing a multiplicity of heavy discrete shot particles freely separable from each other at least upon impact with a target after firing, and a separate tip extending into and frangibly sealed to and closing the open end of the hollow casing, the tip being of impact frangible material which will disintegrate into numerous particles upon impact with a target, the casing and tip being of such dimensions, materials, and configurations as to constitute an integral bullet sized spin stabilized missile resistant to deformation or destruction during firing in a rifled bore and until impact with a target to break the frangible seal and release the multiplicity of shot particles to scatter outwardly separately in the target.

Also in accordance with the invention, a spin stabilized multi-component bullet assembly for rifled bore small arms comprises a hollow missile casing for releasable coupling with a cartridge carrying a propellant charge, the casing having a closed base end, at least a major portion of the casing being of substantially cylindrical configuration and defining substantially the full calibre of the bullet, impact frangible closure means comprising a separate tip extending into and closing the other end of the casing, the tip being of impact frangible material which will disintegrate into numerous particles upon impact with a target, and a multiplicity of discrete shot particles enclosed in the hollow casing, the casing and closure means being of such dimensions, materials and configurations as to constitute an integral bullet sized spin stabilized missile resistant to substantial deformation or destruction during firing in a rifled bore and until impact with a target whereupon to break the frangible closure means and release the multiplicity of shot particles to scatter outwardly separately in the target.

Preferably the casing, tip and shot particles are of distinct preformed construction so as to be assembleable and disassembleable, and preferably the major components are formed of different materials. The tip preferably is crimped to the casing. Preferably, but not necessarily, the casing also contains a liquid.

The invention also comprises a method of making bullets as described, comprising inserting into the hollow casing the multiplicity of heavy shot particles through the open end, inserting the tip so as to close the open end, and securing the tip therein, preferably by crimping.

The invention also comprises a bullet as described mounted in, closing and releasably coupled to the open end of a cartridge carrying a propellant charge, the cartridge being crimped about the casing.

The invention is further described with reference to the drawings wherein.

Figure 1:
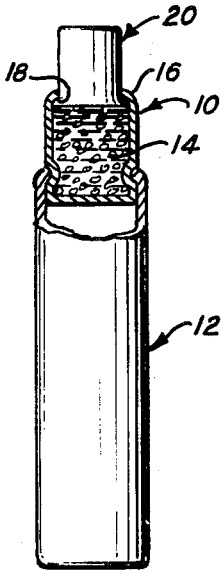
FIG. 1 shows an assembled bullet.

Referring to FIG. 1, the bullet comprises a casing thin which is a tin-walled capsule of copper or possibly of deformable plastic, the plastic being sufficiently high temperature-resistant to maintain its body and shape at about 450°C, as needed for the very short period of time in traversing the bore of the gun, during which it develops relatively high temperatures without breaking in the gun or being destroyed as it leaves the muzzle. There are numerous high temperature plastics of silicone, boron and carbon available on the market today which would be usefully used for cartridge casing material because of their high temperature resistance and substantial strength at high temperatures. The bullet 10 will be mounted to a propellant charge within a cartridge 12 (only a portion being shown), and which is of conventional structure, sized to fit about the lower end of the bullet, and within the bore of the gun, carrying a propellant charge selected to control the desired bullet velocity.

The casing 10 is filled with heavy particles, possibly without, but preferably with, any liquid containing the heavy particles, preferably a highly viscous liquid to semi-solid gelatinous body such as highly viscous lubricating oil or a liquid polymer such as polyisobutylene having a molecular weight between about 2,000 and 15,000, petroleum jelly (petrolatum) and lighter gelated liquids such as oil or water or alcohol gelated with cellulose acetate, methylcellulose and soaps such as sodium stearate or abietate or other commonly known gelating agents, heavy vegetable oils, heavy silicone liquid and the like. The liquid, as pointed out, can be a light liquid but preferably has a minimum viscosity of 100 SSU at 210°F, but any lighter liquid can be used as such. The liquid, however, is usually thickened to desired viscosity. It may have an initial viscosity less than this, and which is then thickened as desired by adding gelating agents thereto to increase the viscosity up to or exceeding the same minimum. The upper limit may be a semi-solid state such as a semi-solid oil or paste.

The casing contains heavy particles such as fine metal particles, typically lead particles ranging from so-called "chilled" lead which may be very fine, but is usually at least as large as dust size. A preferred size is available commercially as No. 12 National Lead, and may range upward in size from "dust" shot, so termed by a commercial distributor Olin, up to large size particles. In practical size this will vary from about 200 up to about 25 U.S. standard sieve; for example, about as large as BB shot. Dust and larger sizes of lead shot are well recognized in the art as set forth in SMOKELESS SHOTGUN POWDERS by Wallace H. Coxe, published by Dupont, with a 1933 copyright, on page 79.

The particles are evenly distributed throughout the casing and the viscous liquid or gel, where used whereby the shot is merely packed solid as to be only homogeneously wet therewith. Thus, while the particles are loose, in that they are held together only by the viscous liquid, the concentration is such that the particles comprise some 65 to 95% by volume of the filler. An identifying characteristic of this particle-filled liquid is that the particles are freely separable from each other upon impact into the target, individual particles scattering as such, and do not penetrate the target as a solid body. Other heavy solid substances may be substituted for the metal particles, typically lead oxide or zinc oxide, barium sulfate and other heavy particle substances insoluble in the viscous liquid, and tending to greatly increase the specific gravity of the viscous carrier liquid with which the heavy solids may be suspended or merely coated. The heavy, particle-filled liquid 14 is loaded into the cartridge 10, filling the same, the filling being sealed by crimping the upper end 16 of the cartridge, about a protruding flange 18 of the bullet tip 20.

The bullet tip 20 is preferably a frangible plastic which will disintegrate on impact with the target surface into numerous small fragments or particles. For this purpose teflon, polysilicone, nylon, polystyrene, polystyrene impact and polystyrene copolymer with acrylonitrile and butadiene, known commercially as ABS, may be used. Of these several plastic tip substances, virgin teflon is preferred because it maintains its integrity in the gun bore without disintegration at substantial temperatures and pressures, and tends also to lubricate the bore and maintain the bullet without destruction in the bore or as it leaves the muzzle; but, under impact with the target, will be broken into small pieces scattering divergently into the target along with the particles as it enters the surface of the target. The tip 20 secured to the casing 10 by the frangible joint 16 is so constructed to maintain the bullet integral in projection and flight, but the assembly is frangibly separable upon impact with the surface of the target as described, the several particles including fragmentation of the plastic tip scattering conically within the target.

As thus described, a bullet is provided having a hollow casing filled with heavy particles and which is frangibly sealed to a closure tip. This bullet may be fired from a handgun or rifle and will retain its structural integrity as a filled casing closed by a tip until it strikes the target. On the target surface the bullet breaks at the tip as shown in the drawings and expells the heavy particles which enter and scatter through the target. Where, as is possible, but not preferred, the hollow casing of the bullet is filled with dry heavy particles, it will break and the particles will enter and scatter through the target quite widely and these heavy particles will penetrate the target only shallowly, drawn widely spread in the conical lines A of FIG. 3. Where the particles are disposed within a liquid, they will spread in a more or less regular conical pattern within the target. The conical spread of heavy particles within the target will be narrower; that is, the cone will have a lower diameter, where the liquid is most viscous; that is, gelatinous or pasty, such conical spread being within the narrower cone defined by the lines C. The conical spread, however, will be wider, of larger diameter, where the liquid is viscous; that is, substantially less viscous than the gelatinous or pasty form, supplying thereby a wider conical spread with, however, a target penetration of smaller or intermediate depth, as shown between the conical lines B. Thus, there will be a conical spread of heavy particles within the target generally proportional to the viscosity of the liquid, spreading wider with lower viscosity; quite wide with only shallow penetration where no liquid is used; and scattering conically within a small diameter and with deeper penetration where the liquid is quite viscous. Consequently, it will be apparent that the type of penetration of the heavy particles within the target will vary in a regular conical pattern with the character of the liquid, as is preferred, and will scatter widely with very shallow penetration when no liquid is used, according to the diagrammatic lines A, B and C illustrating such spread.

An important advantage of such construction is that the bullet is readily broken upon impact, even at low angles, such as about 8°, and the bullet will not ricochet off of the target, even at such low angle. Since the tip breaks into fragments upon entering the target, it will not pass through and will do no damage by ricocheting or passing through the target onto a secondary target.

Some of the listed plastics including teflon may, however, at very high muzzle velocities and high temperatures and pressures developed within the bore of the gun, tend to break up in flight as it leaves the muzzle, whereby it may be desirable for some bullets to further reenforce the plastic tip for use at such high velocities, whereby it will retain its integrity, shape and configuration, at least until impact with the target. With some reenforcements, such as a strong fiber, such as strong fiberglass, the tip will not be destroyed upon impact with the target, but will enter the target without disintegration. A lead tip may also be substituted for the plastic tip, in which event the tip also may not be broken up into particles either upon impact with the target or after substantial penetration of the target, depending upon the construction and material used in the formation of the tip. Such lead tip, as usual, does not need fiber reenforcement. However, whatever tip is used, the thin cartridge crimped there will separate upon impact with the target to allow the heavy liquid and particles to pass into the target and be distributed in a wide scattering such as conically within the target body.

Figure 2:
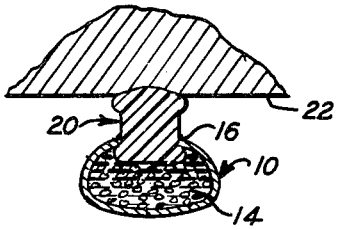
FIG. 2 shows the deflection of the casing upon impact and breaking at the joint of the tip.
Figure 3:
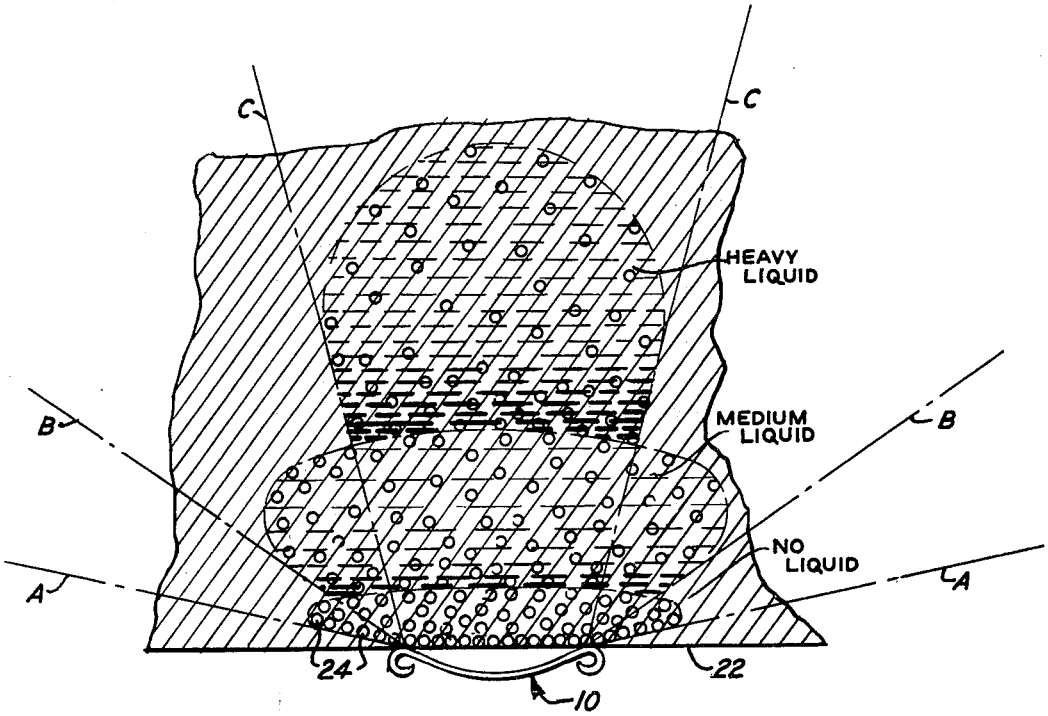
FIG. 3 shows the bullet entering the target and diffusion of the metal particles from the point of impact.

As shown in FIGS. 2 and 3, the bulging of the cartridge 10 is shown exaggeratedly as the tip 20 engages the target surface 22. At the point of impact the edges of the cartridge 10 will separate from the tip, as shown in FIG. 3, and the particles 24 will be distributed widely within the body of the target. As shown in FIG. 3, in particular, the unreinforced plastic 20 also disintegrates into fragments which appear substantially similar to the metallic particles and become widely distributed therewith in the target body.

The following are typical working examples of the invention described herein:

EXAMPLE I

A cartridge for a Python revolver, having a 6 inch barrel, using a .357 Magnum calibre cartridge case containing 5.5 grains of Bulls Eye and a CCI small pistol primer, is loaded with a projectile filled with petrolatum and with tightly packed No. 12 Lawrence brand lead shot, so that the total particle volume is 90% shot and the projectile weight is approximately 85 grains. The projectile casing is a thin copper sheath having a virgin teflon nose cap of solid teflon plastic, as shown in FIG. 1. When the cartridge, loaded as above described, is fired into dry cypress wood surface at an angle of 8°, there is a gouging of the target surface, the projectile disintegrating and scattering particles for a distance of a few feet. However, there is no ricochet, as in the case of any small arms projectile now in use. Even more complete disintegration occurs when this projectile is fired at a water surface at an angle of 8°; and, again, there is no ricochet. When striking a target at angles of 10° to 90°, there is increasing penetration of the target surface, the disintegration of the projectile occuring deeper within the target as the angle of impact increases. The heavy petrolatum liquid will, however, impart to this bullet a narrow conical spread confined within the lines C of FIG. 3, with relatively deep penetration within the target, as shown.

EXAMPLE II

The bullet formed as in Example I is repeated except that a liquid lubricant of medium viscosity lubricating oil such as 120 at 210°F SSU is used. The conical spread of the shot will be roughly approximate to that shown within the lines B of FIG. 3, indicating a substantially wider conical spread and a substantially shallower depth of penetration of the shot within the target.

The use of a much lighter liquid would allow a substantially wider conical spread and even more shallow penetration.

If the liquid were omitted entirely, using the same shot filler, then the shot would scatter even more widely, having relatively even more shallow penetration with wide scattering, substantially as shown by the limits defined by the line A of FIG. 3. The utility of the liquid to supply a significantly deep penetration of the shot into the target is apparent.

The filler is disposed in an easily frangible casing which may be of thin metal or plastic, easily separable on impact from the bullet tip upon striking the target. The tip itself may be of frangible or fiber reenforced plastic which maintains its integrity for medium velocity bullets, the unreenforced being broken up into small particles upon impact; but reenforced by fiber such as fiberglass, the tip will not be destroyed upon impact but will permit deeper penetration with the target. Alternatively, the tip may be formed of metal, such as lead, which will retain its body briefly upon impact, permitting deep disintegration within the target, as desired.

Various modifications will occur to those skilled in the art. It will be understood that the jacket may be one-half to full jacket for hand guns; or three-fourths to full jacket for rifles. The jacket may be cannelured and shaped, sized and strengthened to conform to various guns with smooth or rifled bores. Accordingly, it is intended that the description given above be regarded as exemplary and not limiting, except as defined in the claims as appended hereto.

What is claimed is:

1. A spin stabilized bullet for rifled bore small arms comprising a hollow open-ended missile casing formed for releasable coupling with a cartridge carrying a propellant charge, said casing being of substantially cylindrical form over at least the major portion of its length such that said major cylindrical portion defines substantially the full caliber of the bullet, said casing having a closed base end, said casing enclosing a multiplicity of heavy discrete shot particles freely separable from each other at least upon impact with a target after firing, and a separate tip extending into and frangibly sealed to and closing the open end of said hollow casing, said tip being of impact frangible material which will disintegrate into numerous particles upon impact with a target, said casing and tip being of such dimensions, materials and configurations as to constitute an integral bullet sized spin stabilized missile resistant to deformation or destruction during firing in a rifled bore and until impact with a target to break said frangible seal and release said multiplicity of shot particles to scatter outwardly separately in the target.

2. A bullet as claimed in claim 1 wherein said casing, said tip, and said shot particles are of distinct preformed construction so as to be assembleable and disassembleable.

3. A bullet as claimed in claim 2 wherein said tip is of a material different from said casing.

4. A bullet as claimed in claim 1 wherein said casing and said shot particles are formed of different materials.

5. A bullet as claimed in claim 1 wherein said casing and said tip are formed of different materials.

6. A bullet as claimed in claim 1 wherein said tip is blunted or rounded.

7. A bullet as claimed in claim 1 wherein said open end of said casing is crimped about said tip.

8. A bullet as claimed in claim 1 wherein said tip is of a plastic material.

9. A bullet as claimed in claim 1 wherein said shot particles are of metal.

10. A method of making the bullet of claim 1 comprising inserting into said hollow casing said multiplicity of heavy shot particles through said open end, inserting said tip so as to close said open end, and securing said tip therein.

11. A method as claimed in claim 10 wherein said securing is by crimping said open end about said tip.

12. A bullet as claimed in claim 1 mounted in, closing and releasably coupled to the open end of a cartridge carrying a propellant charge, said cartridge being crimped about said casing.

13. A spin stabilized multi-component bullet assembly for rifled bore small arms comprising a hollow missile casing for releasable coupling with a cartridge carrying a propellant charge, said casing having a closed base end, at least a major portion of said casing being of substantially cylindrical configuration and defining substantially the full caliber of the bullet, impact frangible closure means comprising a separate tip extending into and closing the other end of said casing, said tip being of impact frangible material which will disintegrate into numerous particles upon impact with a target, and a multiplicity of discrete shot particles enclosed in said hollow casing, said casing and closure means being of such dimensions, materials and configurations as to constitute an integral bullet sized spin stabilized missile resistant to substantial deformation of destruction during firing in a rifled bore and until impact with a target whereupon to break said frangible closure means and release said multiplicity of shot particles to scatter outwardly separately in the target.

14. A bullet as claimed in claim 13 wherein said shot particles and said casing are of distinct preformed constructions so as to be assembleable and disassembleable.

15. A bullet as claimed in claim 14 wherein said shot particles and said casing are formed of different materials.

* * * * *